US010303097B2

(12) United States Patent
Nakashima et al.

(10) Patent No.: US 10,303,097 B2
(45) Date of Patent: May 28, 2019

(54) IMAGE HEATING APPARATUS HAVING A HEATER AND A SUPPORTING MEMBER THAT ARE BONDED TOGETHER AT LATERAL SURFACES THEREOF USING AN ADHESIVE

(71) Applicant: CANON KABUSHIKI KAISHA, Tokyo (JP)

(72) Inventors: Yusuke Nakashima, Yokohama (JP); Atsuhiko Yamaguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 14/716,147

(22) Filed: May 19, 2015

(65) Prior Publication Data

US 2015/0338804 A1 Nov. 26, 2015

(30) Foreign Application Priority Data

May 20, 2014 (JP) ..... 2014-104284
Mar. 25, 2015 (JP) ..... 2015-062476

(51) Int. Cl.
*G03G 15/20* (2006.01)
*H05B 1/02* (2006.01)
(Continued)

(52) U.S. Cl.
CPC ..... *G03G 15/2053* (2013.01); *H05B 1/0241* (2013.01); *H05B 3/0095* (2013.01);
(Continued)

(58) Field of Classification Search
CPC ..... G03G 15/2053; G03G 2215/2035; H05B 1/0241; H05B 3/0095; H05B 3/141; H05B 6/107
(Continued)

(56) References Cited

U.S. PATENT DOCUMENTS 5,351,114 A 9/1994 Matsuno
5,499,087 A 3/1996 Hiraoka et al.
(Continued)

FOREIGN PATENT DOCUMENTS

JP H05-289555 A 11/1993
JP H05-313528 A 11/1993
(Continued)

OTHER PUBLICATIONS

U.S. Appl. No. 14/733,283, filed Jun. 8, 2015.
(Continued)

*Primary Examiner* — Dana Ross
*Assistant Examiner* — Joe E Mills, Jr.
(74) *Attorney, Agent, or Firm* — Venable LLP

(57) ABSTRACT

An image heating apparatus includes a cylindrical film, and a heater having a substrate, and a heat generating element provided on the substrate. The heater has an elongated plate-like shape, and a first surface contacting the film, a second surface opposite to the first surface, and a heater lateral surface facing outwardly in a widthwise direction of the heat generating element. A supporting member supports the heater, and includes a recess and a supporting lateral surface that is parallel to and opposes the heater lateral surface. The supporting lateral surface is provided in the recess, and is bonded to the heater lateral surface using an adhesive material. A high heat conduction member has a thermal conductivity greater than a thermal conductivity of the substrate, and contacts the second surface of the heater and is sandwiched between the heater and the supporting member.

9 Claims, 10 Drawing Sheets

(51) Int. Cl.
*H05B 3/00* (2006.01)
*H05B 3/14* (2006.01)
*H05B 6/10* (2006.01)

(52) U.S. Cl.
CPC ..... *H05B 3/141* (2013.01); *H05B 6/107* (2013.01); *G03G 2215/2035* (2013.01)

(58) Field of Classification Search
USPC ..... 219/216; 399/329
See application file for complete search history.

(56) References Cited

U.S. PATENT DOCUMENTS

| | | | | |
|---|---|---|---|---|
| 7,235,761 | B1 | 6/2007 | Maul et al. | |
| 8,983,328 | B2 | 3/2015 | Mizuta et al. | |
| 2005/0258158 | A1* | 11/2005 | Takami | G03G 15/2042 219/216 |
| 2005/0285244 | A1* | 12/2005 | Chen | H01L 21/568 257/678 |
| 2007/0278203 | A1* | 12/2007 | Creteau | H05B 3/0095 219/216 |
| 2012/0000897 | A1* | 1/2012 | Shimura | G03G 15/2078 219/216 |
| 2012/0121306 | A1* | 5/2012 | Shimura | H05B 3/0095 399/329 |
| 2013/0108306 | A1 | 5/2013 | Saito et al. | |
| 2013/0299480 | A1* | 11/2013 | Kakubari | G03G 15/2053 219/216 |
| 2014/0076877 | A1* | 3/2014 | Cheng | H05B 3/34 219/212 |
| 2014/0138372 | A1* | 5/2014 | Ogura | G03G 15/2042 219/216 |
| 2015/0139672 | A1 | 5/2015 | Nakashima et al. | |
| 2015/0139681 | A1 | 5/2015 | Mizuta et al. | |

FOREIGN PATENT DOCUMENTS

| | | |
|---|---|---|
| JP | 06-175517 | 6/1994 |
| JP | 11-84919 | 3/1999 |
| JP | 2000-206809 | 7/2000 |
| JP | 2002-368234 A | 12/2002 |
| JP | 2003-007435 | 1/2003 |
| JP | 2003-317898 | 11/2003 |
| JP | 2006-235550 | 9/2006 |
| JP | 2008-216741 | 9/2008 |
| JP | 2014-102429 | 6/2014 |

OTHER PUBLICATIONS

U.S. Appl. No. 14/716,147, filed May 19, 2015.
Japanese Office Action, dated Jan. 22, 2019, in Japanese Patent Application No. 2015-062476.

* cited by examiner

IMAGE HEATING APPARATUS HAVING A HEATER AND A SUPPORTING MEMBER THAT ARE BONDED TOGETHER AT LATERAL SURFACES THEREOF USING AN ADHESIVE

This application claims the benefit of Japanese Patent Applications Nos. 2014-104284 filed on May 20, 2014 and 2015-062476 filed on Mar. 25, 2015, which are hereby incorporated by reference herein in their entirety.

FIELD OF THE INVENTION AND RELATED ART

The present invention relates to an image heating apparatus for an image forming apparatus, such as an electrophotographic copying machine or an electrophotographic printer.

In an image forming apparatus, such as a copying machine or a printer, using an electrophotographic type process, a heating type image heating apparatus for fixing an unfixed toner image into a fixed image by heating a recording material (recording paper) carrying a formed unfixed toner image is widely used.

In such an image forming apparatus using the image heating apparatus, when recording sheets having a width smaller than that of a usable maximum sheet width are continuously processed to effect printing, a so-called non-sheet-passage-part temperature rise occurs in the image heating apparatus. By the non-sheet-passage-part temperature rise, a temperature of a region of a fixing nip of the image heating apparatus, with respect to the longitudinal direction, where the recording paper does not pass, gradually rises. The durability against a thermal stress stemming from the increase of the electrical power supplied to the heating element to meet the recent demand for the high printing speed is desired.

One method for meeting the desire is disclosed in Japanese Laid-open Patent Application No. 2003-317898, in which a high heat conduction member having a high thermal conductivity in a surface direction, as compared with that of a substrate of the heating element, is nipped between the heating element and a supporting member for the heating element. It is intended to reduce the temperature rise of the non-sheet-passage-part by the high heat conduction member.

In a case in which the heating element (heater) is supported by the supporting member, the heating element and the supporting member may be required to be bonded with each other by an adhesive material, and the heating element may be required to be inserted in a recess of the supporting member.

In a case in which the high heat conduction member is placed between the heating element and the supporting member in the structure where the heating element and the supporting member are formed and bonded with each other by an adhesive material, however, a problem arises. That is, a hole is formed in the high heat conduction member, and an adhesive material for bonding the heating element to the supporting member may contact the high heat conduction member, such that a uniform heating property of the high heat conduction member is deteriorated in an area corresponding to the hole formed in the high heat conduction member.

SUMMARY OF THE INVENTION

Accordingly, it is an object of the present invention to provide an image heating apparatus in which the high heat conduction member is provided between the heating element (heater) and the supporting member, and the heating element and the supporting member are bonded with each other.

According to one aspect, the present invention provides an image heating apparatus comprising a heater including a substrate and a heat generating element provided on the substrate, a supporting member supporting the heater, the supporting member being provided with a recess for receiving the heater, a high heat conduction member having a thermal conductivity, at least in a direction parallel with a surface, that is greater than a thermal conductivity of the substrate, the high heat conduction member being sandwiched between the heater and the supporting member, wherein a recording material carrying an image is heated by heat from the heater, and wherein a side surface of the heater and a surface, defining the recess and opposing the side surface of the heater, of the supporting member are bonded by an adhesive material with each other to affix the heater and the supporting member to each other.

According to another aspect, the present invention provides an image forming apparatus comprising such an image heating apparatus.

Further features of the present invention will become apparent from the following description of exemplary embodiments with reference to the attached drawings.

DESCRIPTION OF THE EMBODIMENTS

Embodiment 1

(1) Image Forming Station

Figure 3:
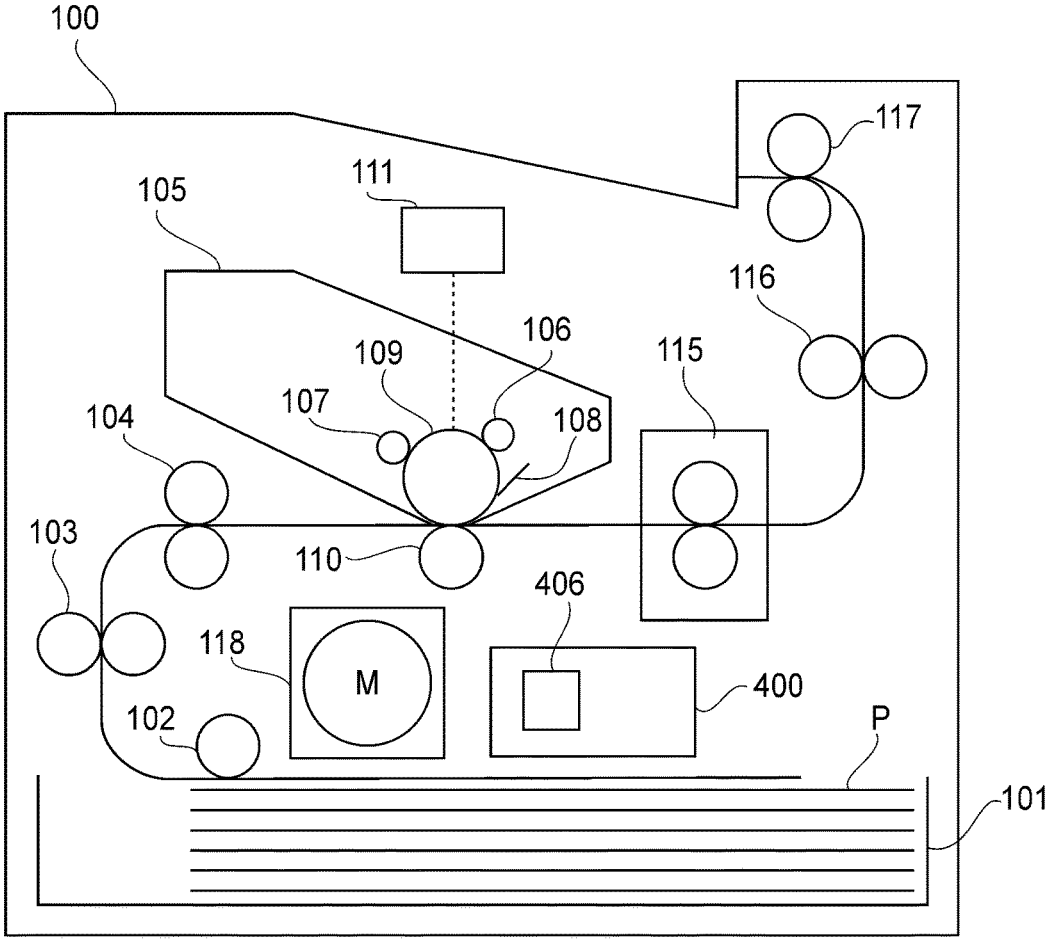
FIG. 3 illustrates an image forming apparatus.

FIG. 3 is a schematic view showing a schematic structure of the image forming apparatus 100. A recording material (recording paper or sheet) P stacked in the sheet feeding cassette 101 is fed to a process cartridge 105 at predetermined timing by a pick-up roller 102, sheet feeding rollers 103, and registration rollers 104.

The process cartridge 105 comprises charging means 106, developing means 107, cleaning means 108, and a photosensitive drum 109. A known electrophotographic process operation is carried out with a laser beam emitted from image exposure means 111, so that an unfixed toner image is formed on the photosensitive drum 109.

The unfixed toner image is transferred from the photosensitive drum 109 onto the recording paper P by the transferring means 110, and then the recording paper P is introduced into a fixing portion (image heating apparatus, or fixing device) 115, where it is subjected to a heat pressing process, so that the toner image is fixed on the recording paper P. Thereafter, the recording paper is discharged to the outside of the main assembly of the image forming apparatus 100 through the middle sheet discharging roller 116 and the sheet discharging roller 117, and finishes the series of a printing operation. A motor applies a driving force to each unit including the image heating apparatus 115. The image heating apparatus 115 is controlled by a ceramic heater driving circuit 400 and a central processing unit (CPU) 406.

The image forming apparatus 100 of this embodiment can be operated with a plurality of sheet sizes. That is, the printing can be effected on a plurality of sheet sizes, such as Letter size sheets (approx. 216 mm×279 mm), A4 sheets (210 mm×297 mm), and A5 sheets (148 mm×210 mm), set in the sheet feeding cassette 101. Among the sheets usable with the image forming apparatus 100 (under the catalog specifications), a largest width sheet is the Letter size sheet (approx. 216 mm width). In the description of the embodiments, a sheet (A4, A5 sheets) having a width smaller than the largest width is called small size sheet.

(2) Fixing Device (Image Heating Apparatus)

(2-1) General Structure of the Apparatus

Figure 4:
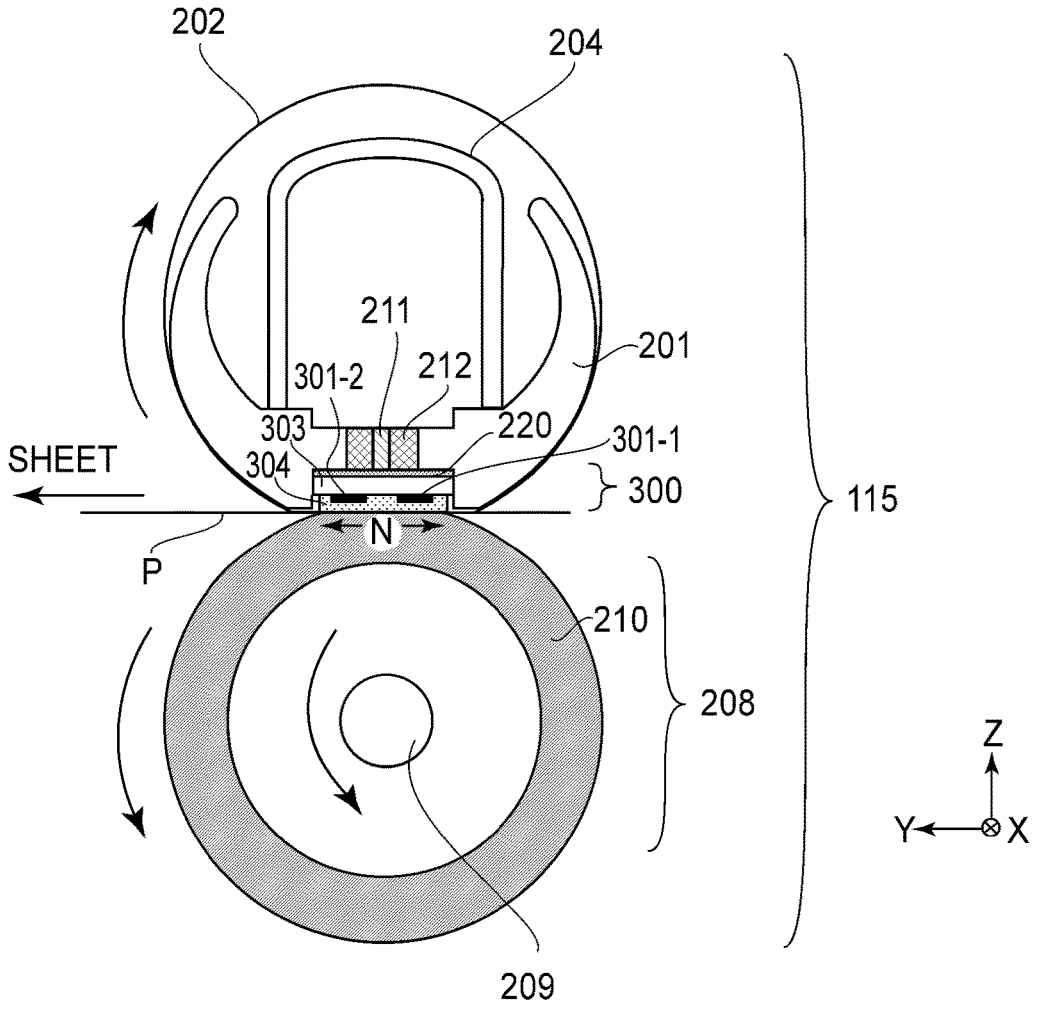
FIG. 4 illustrates an image heating apparatus according to Embodiment 1 of the present invention.

FIG. 4 is a lateral schematic sectional view of major parts of the fixing device 115 of the image forming apparatus 100. The fixing device 115 comprises a cylindrical film (movable member) 202, a heater (heating element) 300 that contacts an inner surface of the film 202, and a pressing roller (nip forming member) 208 cooperative with the heater 300 to form a fixing nip N with the film 202 therebetween. The film 202 includes a base layer formed of a heat resistive resin material, such as polyimide, or a metal, such as stainless steel. The pressing roller 208 includes a metal core 209 formed of steel, aluminum, or the like, and an elastic layer 210 formed of silicone rubber, or the like.

The heater 300 is supported on a heater supporting member (heating element supporting member) 201 made of a heat resistive resin material. The heater supporting member 201 functions also as a guiding member for guiding rotation of the film 202. The pressing roller 208 receives power from a motor 118 and is rotated in the direction indicated by an arrow. By the rotation of the pressing roller 208, the film 202 is rotated. Designated by 204 is a stay, made of metal, for applying a pressure to the heater supporting member 201 using a spring (unshown).

The heater 300 is a ceramic heater elongated in the direction perpendicular to the sheet feeding direction in a recording paper feeding path plane, and it includes a heater substrate 303 formed of a ceramic material. The heater 300 also includes a heat generating resistor (heat generating element) 301-1 provided on the heater substrate 303 and extending along the longitudinal direction of the heater substrate 303, and a heat generating resistor 301-2 extending along the longitudinal direction of the heater substrate 303 at a position that is different from that of the heat generating resistor 301-1 in the widthwise direction of the heater substrate 303. The heater 300 further includes an insulative surface protection layer 304 (formed of a glass material in this embodiment) coating the heat generating resistors 301-1 and 301-2.

The surface protection layer 304 of the heater 300 is at the sheet passing side (front side of the heater), and the inner surface of the film 202 slides on the protection layer 304 in the nip N portion.

Between the heater supporting member 201 and the heater 300, a high heat conduction member 220 is provided. The high heat conduction member 220 is made of a material that has a thermal conductivity greater than the thermal conductivity of the heater substrate 303 at least in a direction parallel to the surface thereof. An example of the high heat conduction member is a graphite sheet. Another example of the high heat conduction member 220 is a thin metal plate formed of aluminum, or the like.

To the high heat conduction member 220, a thermistor (temperature detecting element) 211 is contacted. In addition, to the high heat conduction member 220, a protection element 212, such as a thermo-switch and/or a temperature fuse, or the like, is contacted to operate to shut off the electric energy supply line to the heat generating region when the temperature of the heater 300 rises.

The thermistor 211 and the protection element 212 are pressed against the high heat conduction member 220 by a leaf spring (unshown), or the like. The recording paper P carrying the unfixed toner image is heated by the fixing nip N while being nipped and fed in the fixing nip N, so that the toner image is fixed.

(2-2) Heater Temperature Control

A heater temperature control will be described. As for the types of the heater temperature control, there are a wave number control, a phase control, and a so-called hybrid control including the wave number control and the phase control in combination. In the phase control, an ON-ratio (duty ratio) is one half wave period of the commercial AC waveform, and is suitable to suppress flickering. On the other hand, in the wave number control, ON or OFF of the heat generating element of the heater 300 is switched in units of half wave units of the commercial AC waveform (i.e., the ON ratio (duty ratio) is switched in a period corresponding to a predetermined number of half waves), and is suitable to suppress harmonic current distortion or switching noise.

In the hybrid control, a part of the half waves in one control cyclic period including a plurality of half waves is phase-controlled, and the rest are wave-number-controlled, by which the production of the harmonic current and/or the switching noise can be suppressed as compared with the case of the phase control alone. Furthermore, as compared with the case of the wave number control alone, the flickering can be reduced. Generally, the image forming apparatus uses only one of the three types of controls, depending on the voltage and/or production of the flickering of the available commercial AC voltage source.

Figure 5:
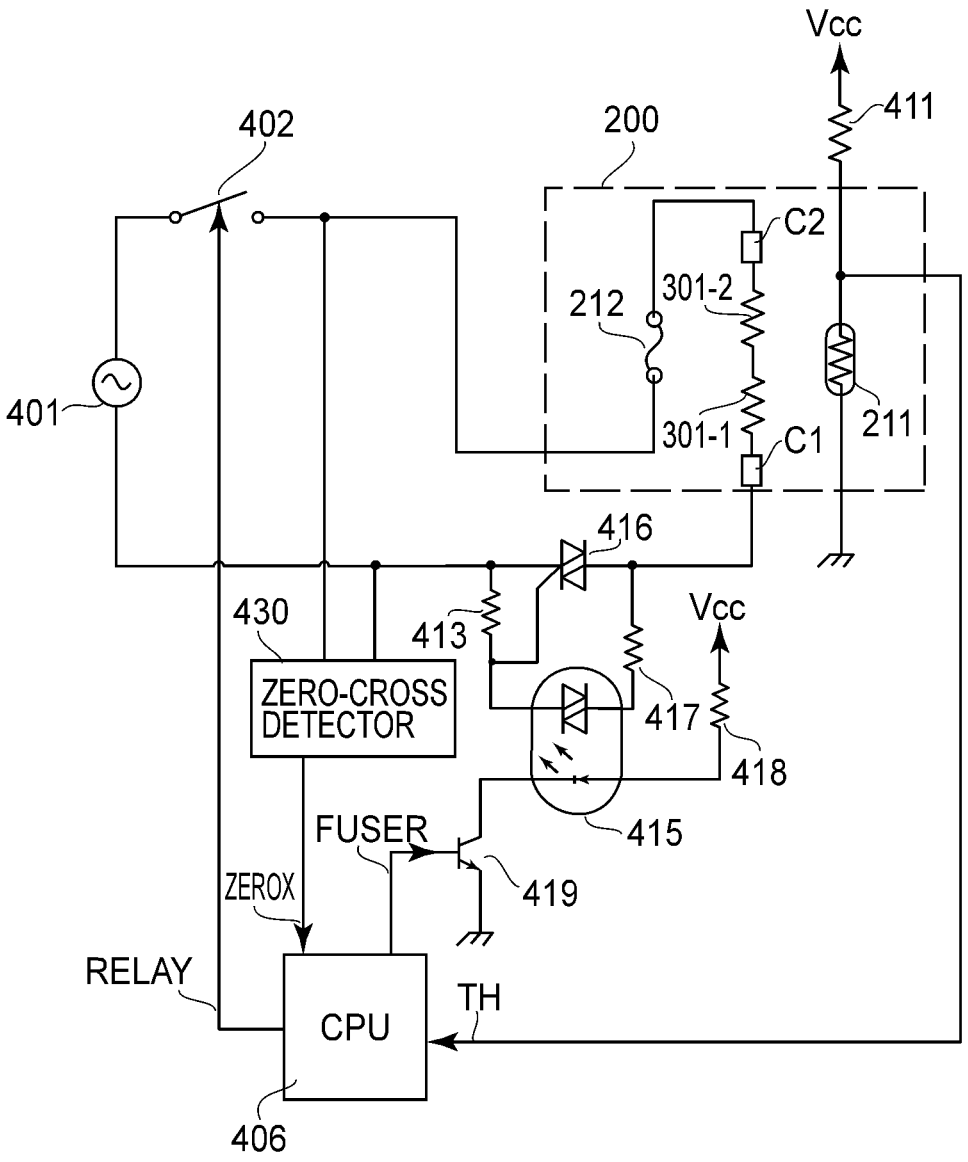
FIG. 5 is a control circuit diagram for a heater.

FIG. 5 illustrates an electrical power control portion 400 of the heater 300 in this embodiment. Designated by reference numeral 401 is a commercial AC voltage source to which the image forming apparatus 100 is connected. The electric power control of the heater 300 is carried out by ON and OFF of a TRIAC 416. The electric power supply to the heater 300 is carried out through contact portions C1 and C2, and the electric power is supplied to the heat generating resistors 301-1 and 301-2 of the heater 300.

A zero-cross detection portion 430 is a circuit for detecting a zero-cross of the waveform of the AC voltage source 401 and supplies a ZEROX signal to the CPU 406. The ZEROX signal is used for the control of the heater 300, and the zero-cross circuit may be the circuit disclosed in Japanese Laid-open Patent Application No. 2011-18027, for example.

The operation of the TRIAC 416 will be described. Resistors 413 and 417 are current limiting resistors for the TRIAC 416, and a photo-TRIAC coupler 415 is a device for assuring a creeping distance between the primary and secondary sides. When a light emitting diode of the photo-TRIAC coupler 415 is turned on, the TRIAC 416 is turned on. The resistor 418 limits the current through the light emitting diode of the photo-TRIAC coupler 415. The photo-TRIAC coupler 415 is rendered on and off by a transistor 419. The transistor 419 is operated in accordance with a FUSER signal supplied from the CPU 406.

The thermistor 211 has a resistance value which changes in accordance with the temperature. To the CPU 406, a TH signal that corresponds to a voltage provided by dividing the voltage Vcc by the resistance value of the thermistor 211 and the resistance value of the resistor 411 is supplied. That is, the signal TH response to the detected temperature by the thermistor 211. In the inside process of the CPU 406, the electrical power to be supplied is calculated by PI control on the basis of the detected temperature of the thermistor 211 and a set temperature for the heater 300. In addition, the CPU 406 calculates a control level (a phase angle in the case of the phase control, and a wave number in the case of the wave number control) correspondingly to the electrical power to be supplied, and controls the TRIAC 416.

If the state of the fixing device 115 becomes an abnormal state exceeding the normal heating state by a malfunction of the electrical power control portion, such as short circuit in the TRIAC 416, for example, the protection element 212 operates to shut off the electrical power supply to the heater 300. Also, when the thermistor detected temperature (TH signal) exceeds a predetermined temperature, a relay 402 is opened to shut off the electrical power supply to the heater 300.

(2-3) Bonding of the Heater to the Heater Supporting Member

FIGS. 1A, 1B, 2A, and 2B illustrate a bonding point between the heater 300 and the heater supporting member 201 in this embodiment. In these figures, only major parts of the supporting member 201 of FIG. 4 are shown, and the other parts, such as the film guide portion, are omitted.

The supporting member 201 is provided with a groove portion (recess) 201A for receiving the heater 300, and the heater 300 received in the groove portion 201A is fixed to the heater supporting member 201 by an adhesive material 600. More specifically, a side surface 300*a* of the heater 300 and the surface 201*a* of the supporting member 201 opposite to the side surface 300*a* of the heater 300 (the surface defining the groove portion 201A) are bonded by the adhesive material 600, so that the heater 300 is fixed to the supporting member 201. The configuration, or the like, of the supporting member 201 will be described in detail.

The supporting member 201 is provided with the groove portion 201A extending in the longitudinal direction of the supporting member (X axis direction in the Figure) and having a channel-like cross-section. The heater 300 is fitted in the groove portion 201A with the sheet passing side (surface side of the heater) facing an outside of the supporting member 201. The high heat conduction member 220 is sandwiched between the seat (the bottom surface of the groove portion) 201*b* and the heater 300. The heater 300 and the heater supporting member 201 are bonded by the adhesive material 600 applied in a space 201-2 between the side surface 300*a* of the heater 300 and an internal wall surface (second surface) 201*a* of the heater supporting member 201. The number of the bonding positions between the side surface 300*a* and the internal wall surface 201*a* may be at least one. The heater 300 is fixed to the supporting member 201 by the adhesive material 600. In this embodiment, the adhesive material 600 used is a heat resistive silicone rubber adhesive material. More specifically, it is silicone rubber KE-3417 (tradename), available from Shinnetsu Silicone Kabushiki Kaisha, of Japan.

The opposite end portions of the supporting member 201 with respect to the longitudinal direction (an X-axis direction) of the supporting member 201 are provided with two projections (heater supporting portions), respectively. A gap 201Wb is provided between the two projections 201-1 opposed to each other in a Y-axis direction (i.e., a clearance is provided between opposing surfaces (first surfaces) of the projections), and is equivalent to or a little bit wider than a width 300W of the heater 300. Therefore, the position of the heater 300 fitted in the groove portion 201A is limited with respect to the Y-axis direction, by the projections 201-1. In this manner, the supporting member 201 has a first surface opposing a side surface of the heater 300, and a second surface opposing the side surface of the heater 300, the second surface being remoter from the side surface of the heater 300 than the first surface, and the adhesive material 600 is applied between the side surface of the heater 300 and the second surface of the supporting member 201.

A dimensional relation between a gap (width) 201Wa between the two surfaces 201*a* of the supporting member 201 opposing in the Y-axis direction and the width 300W of the heater 300 is 201Wa>300W.

In addition, 201Wa>201Wb, and 201Wb≥300W are satisfied.

Figure 1A:
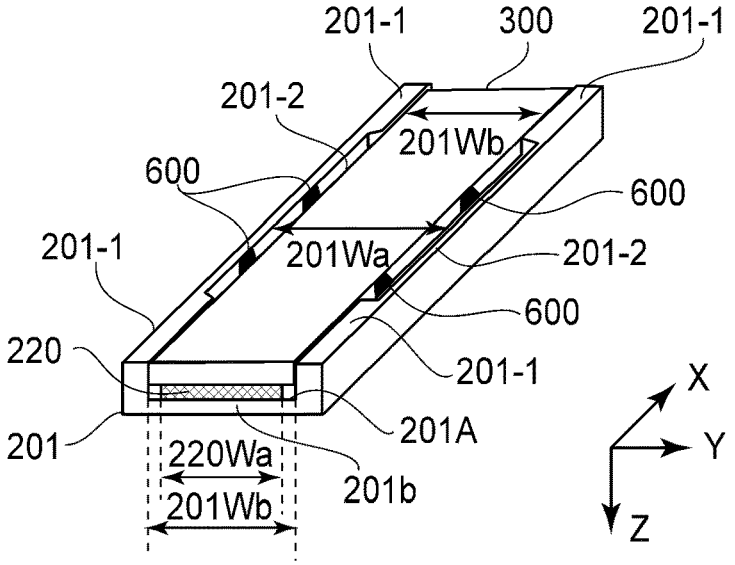
FIGS. 1A and 1B illustrate relationships (No. 1) between a heater, a high heat conduction member, a heater supporting member, and a bonding point.
Figure 1B:
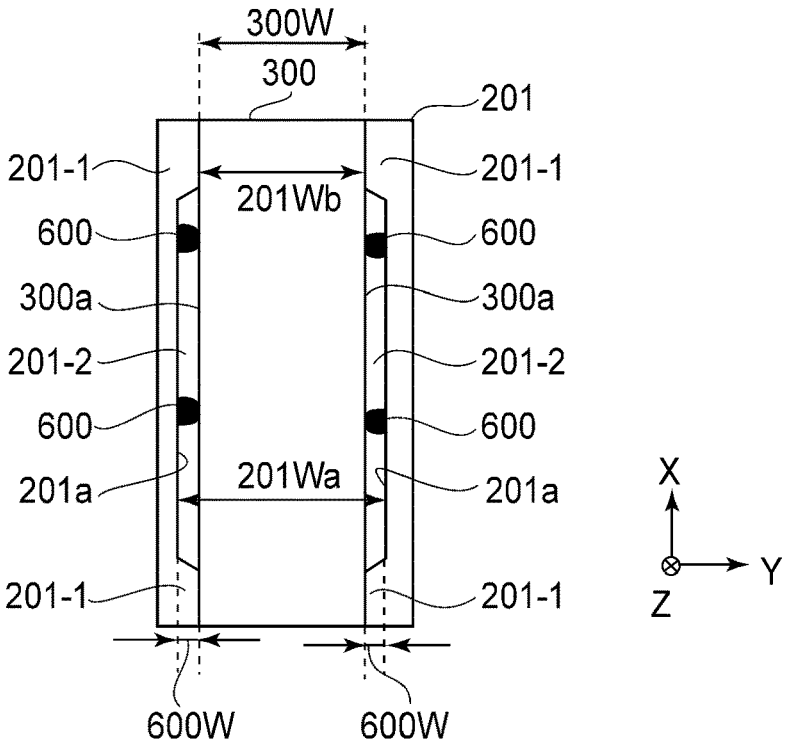

In the example of FIGS. 1A and 1B, the heater 300 and the heater supporting member 201 are bonded by the adhesive material 600 at four positions. As shown FIGS. 1A and 1B, two spaces 201-2 are provided where the adhesive material 600 is applied, and the adhesive material 600 is applied at two positions for each of the spaces. The position of the adhesive material application in one of the spaces 201-2 and that of the other space 201-2 are substantially the same with respect to the X-axis direction (longitudinal direction of the heater).

A distance 600W between the side surface 300*a* of the heater and the surface 201*a* of the supporting member is 600W=(201Wa−300W)/2.

The width 600W is substantially constant along the X-axis direction over the area of surface 201*a*.

Figure 2A:
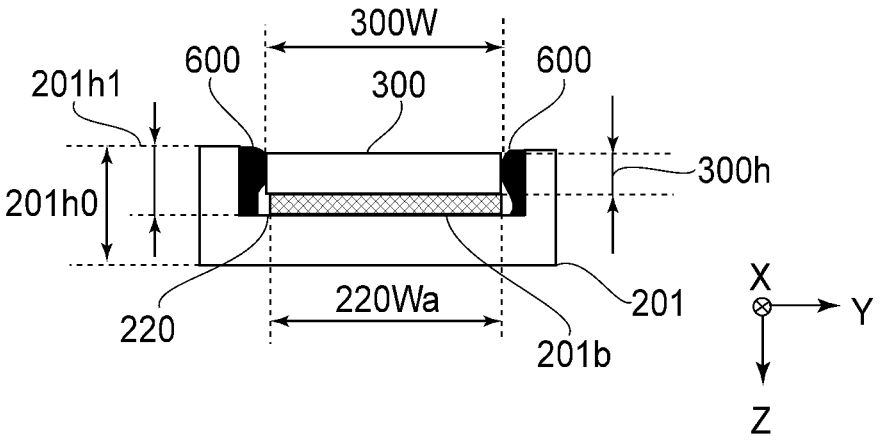
FIGS. 2A and 2B illustrate relationships (No. 2) between a heater, a high heat conduction member, a heater supporting member, and a bonding point.
Figure 2B:
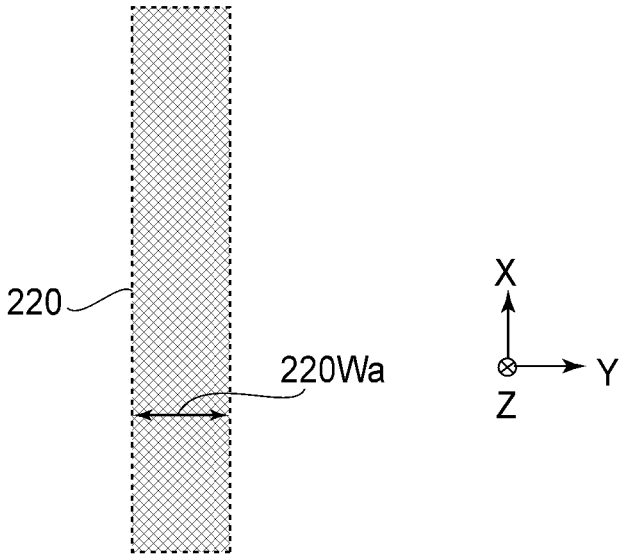

As shown in FIG. 2A, a width 220Wa of the high heat conduction member and the width 300W of the heater 300 satisfy 220Wa≤300W. The side surface 300*a* of the heater 300 has a thickness 300*h*, and the internal wall surface 201*a* of the heater supporting member 201 has a height 201*h*1. The adhesive material 600 is applied in the region of the thickness 300*h* and the region of the thickness 201*h*1 so as not to contact the high heat conduction member 220. By this, the adhesive material 600 does not easily enter between the heater 300 and the high heat conduction member 220, so that the close contact state is maintained. The high heat conduction member 220 is not provided with a cut-away portion for the bonding as shown in FIG. 2B. Therefore, a thermo-conductive performance (uniform heating function) with respect to the direction parallel with the surface of the high heat conduction member 220 can be provided efficiently.

By the provision of the spaces 201-2 for the application of the adhesive material 600 as in this example, it is easy to inject the adhesive material 600 after the high heat conduction member 220 and the heater 300 are inserted into the groove of the supporting member 201, and, therefore, the assembling property of the device is improved.

The dimensional relation between the width 201Wb of the seat 201*b* of the groove portion 201A (FIG. 1A) and the width 220Wa of the high heat conduction member 220 is 201Wb≥220Wa.

In addition, the relationships between the thickness 201*h*0 of the heater supporting member 201, the height 201*h*1 of the wall surface 201*a*, related to the bonding of the heater supporting member 201, and the thickness 300*h* of the heater 300 are 201*h*0>201*h*1>300*h*.

Embodiment 2

In this Embodiment 2, an internal wall surface 201*a* of the heater supporting member 201 is provided with recessed portions 201-3 to clearly define the positioning of the adhesive material 600. The recessed portions 201-3 have a function of confining the adhesive material 600, by which the positional accuracy of the adhesive material application is improved, and the bonding operation is made easy. In the description of this embodiment, the same reference numerals as in Embodiment 1 are assigned to the elements having the corresponding functions in this embodiment, and the detailed description thereof is omitted for simplicity.

Figure 6A:
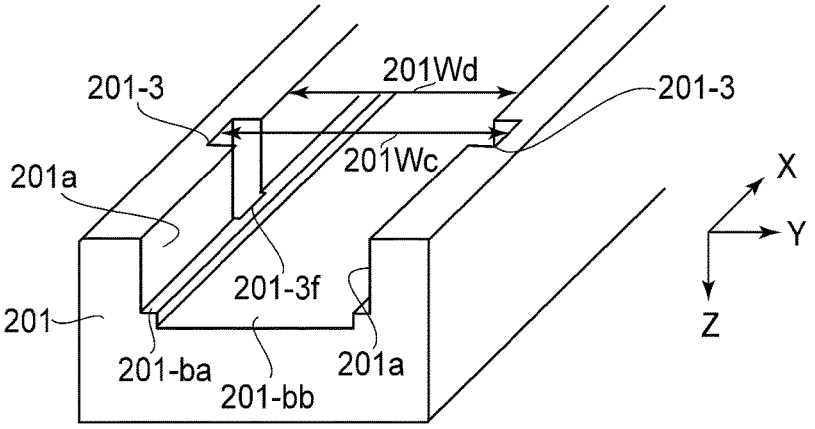
FIGS. 6A, 6B, and 6C illustrate a device according to Embodiment 2.

FIG. 6A shows a schematic structure of Embodiment 2. In this embodiment, the internal wall surface 201*a* of the heater supporting member 201 is provided at the bonding positions with recessed portions 201-3 in the widthwise direction of the supporting member 201. The relationships between the width 300W of the heater 300, the width 201Wd of the groove portion 201A of the heater supporting member 201 (the gap between the opposing surfaces 201*a*), and a width 201Wc of the recess 201-3 is 201Wc>201Wd>300W.

Figure 6B:
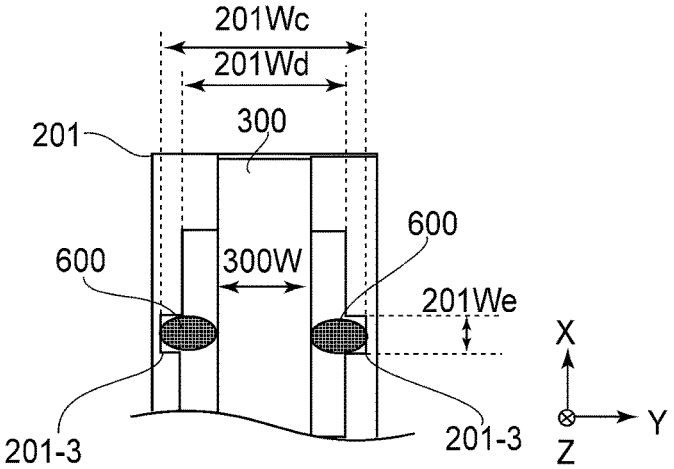
Figure 6C:
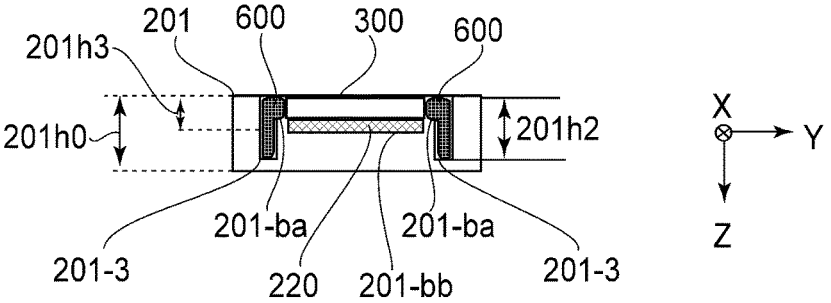

FIG. 6B shows positional relations below the heater 300, the heater supporting member 201, and the adhesive material 600, and FIG. 6C is a sectional view. The recessed portions 201-3 are provided so that they are opposed to the internal wall surface 201*a* of the supporting member 201. The heater supporting member 201 and heater 300 are fixed to each other at the positions of the recessed portions 201-3.

The adhesive material 600 is applied in regions of the recessed portions defined by the width 201We and the depth 201*h*2. Designated by 201*h*0 is a thickness of the heater supporting member 201. Designated by 201*h*3 is a sum of the thickness of the heater 300 or the thickness of the heater supporting member 201 and the thickness of the high heat conduction member 220. The relationships therebetween are 201*h*0>201*h*2≥201*h*3.

With such a structure, the bonding positions are clearly defined, and an excess adhesive material 600 flows into depths of the recessed portions until the adhesive material is cured after the application thereof. By this, protrusion of the adhesive material 600 to the contact portion between the heater 300 and the film 202 can be suppressed.

In addition, a depth of the seat 201-*bb* on which the high heat conduction member 220 is mounted is deeper than the surface 201-*ba* having an entrance edge 201-3*f* of the recessed portion 201-3. By this arrangement, the adhesive material is not easily deposited on the high heat conduction member 220, and the problem of deformation of the high heat conduction member attributable to the shrinkage of the adhesive material is diminished.

Embodiment 3

Figure 7A:
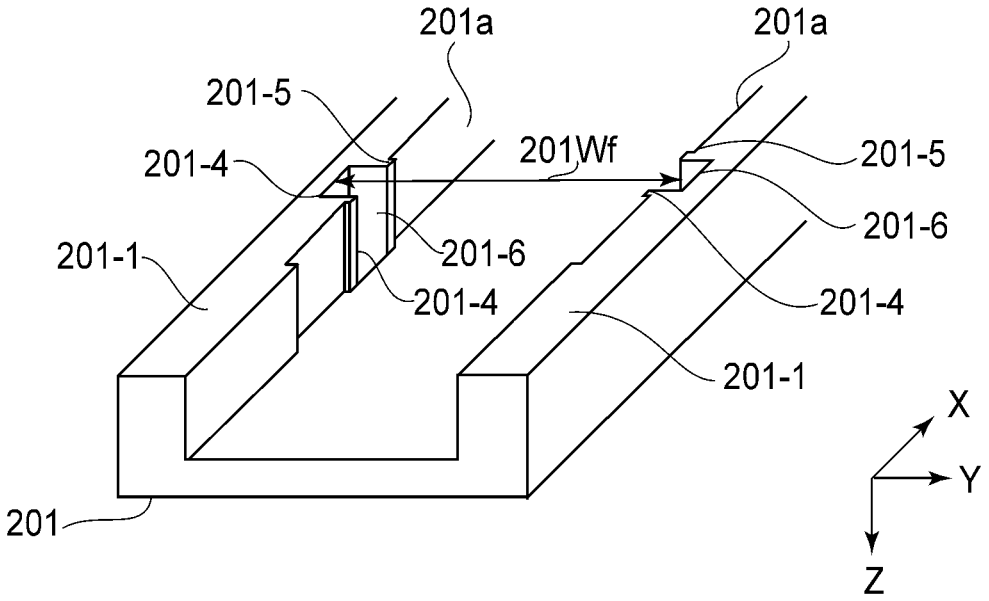
FIGS. 7A and 7B illustrate a device according to Embodiment 3.
Figure 7B:
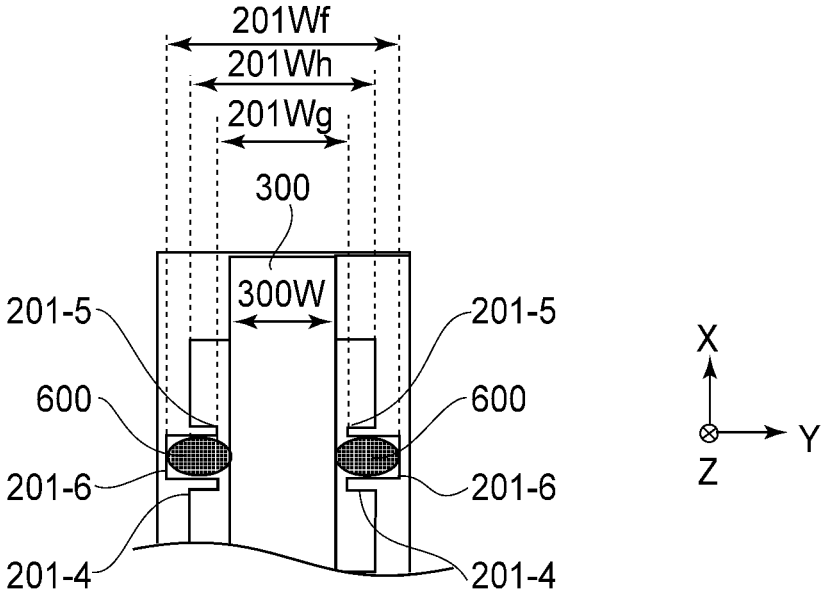

FIGS. 7A and 7B are illustrations of this Embodiment 3. In the description of this embodiment, the same reference numerals as in Embodiments 1 and 2 are assigned to the elements having the corresponding functions in this embodiment, and the detailed description thereof is omitted for simplicity. FIG. 7A shows a schematic structure, and part (b) shows positional relationships of the bonding positions between the heater 300, the heater supporting member 201, and the adhesive material bonding positions. In this Embodiment 3, adhesive material movement prevention walls 201-4 and 201-5 are provided at the bonding positions of the internal wall surface 201*a* of the heater supporting member 201 to prevent the movement of the adhesive material 600 in the longitudinal direction of the heater 300.

The relationships between a width 201Wg between the free end portions of the prevention walls 201-4 and 201-5 opposing to each other in the Y-axis direction, a width 201Wh between the opposing internal wall surfaces 201*a*, a width 201Wf between the opposing recessed portions 201-6, and a width 300W of the heater 300 are 201Wf>201Wh>201Wg>300W.

By the provision of such movement prevention walls 201-4 and 201-5, the protrusion of the adhesive material 600 in the longitudinal direction of the heater 300 can be prevented.

Embodiment 4

Figure 8:
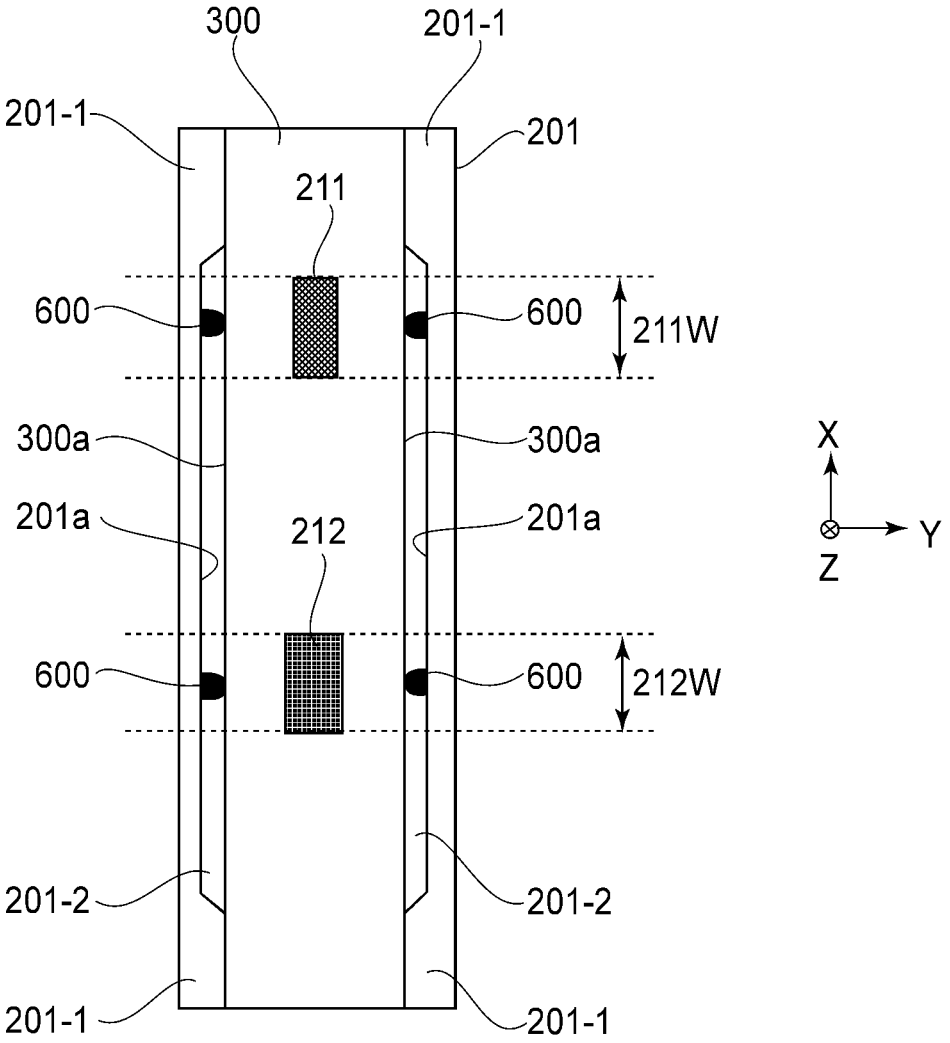
FIG. 8 illustrates a device according to Embodiment 4.

FIG. 8 is an illustration of the device according to Embodiment 4. In this Embodiment 4, the positions of the heater supporting member 201 at which the adhesive material 600 is applied is in the ranges of widths 211W, 212W of the protection element 212 and the temperature detecting element 211, respectively. That is, the bonding positions are adjacent to the positions where the elements 211, 212 are provided, with respect to the X-axis direction. In the description of this embodiment, the same reference numerals as in Embodiments 1, 2, and 3 are assigned to the elements having the corresponding functions in this embodiment, and the detailed description thereof is omitted for simplicity.

Figure 10:
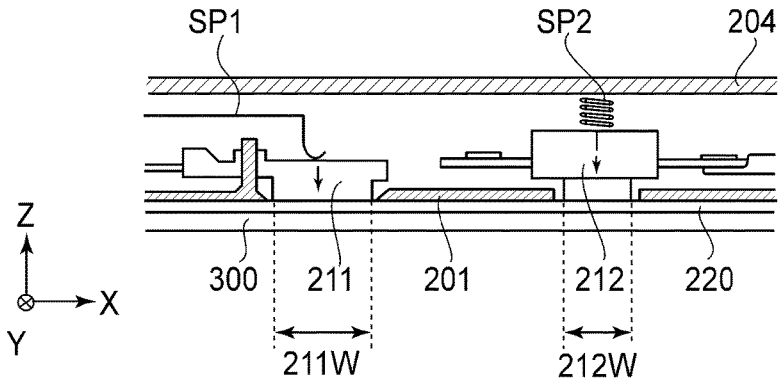
FIG. 10 illustrates a modification of Embodiment 4.

As shown in FIG. 10, the protection element 212 and the temperature detecting element 211 are pressed by springs SP1 and SP2 in the direction of urging the heater 300 away from the seat of the supporting member 201. Therefore, the stress of the heater 300 in these positions is relatively large as compared with the other portions.

The adhesive material 600 is applied in the position of at least one of the width 212W range where the protection element 212 and the high heat conduction member 220 contact each other and the width 211W range where the temperature detecting element 211 and the high heat conduction member 220 contact each other. By this arrangement, the stress of the heater 300 can be eased, and the close contact between the high heat conduction member 220 and the heater 300 is improved. This feature of Embodiment 4 may be used in any one of Embodiments 1, 2, and 3.

With such a structure, it is unnecessary to provide a cut-away portion, for the application of the bonding material 600, in the high heat conduction member 220, and the high heat conduction member 220 can be used efficiently without influence of the structure of the image heating apparatus 115.

Embodiment 5

Figure 9A:
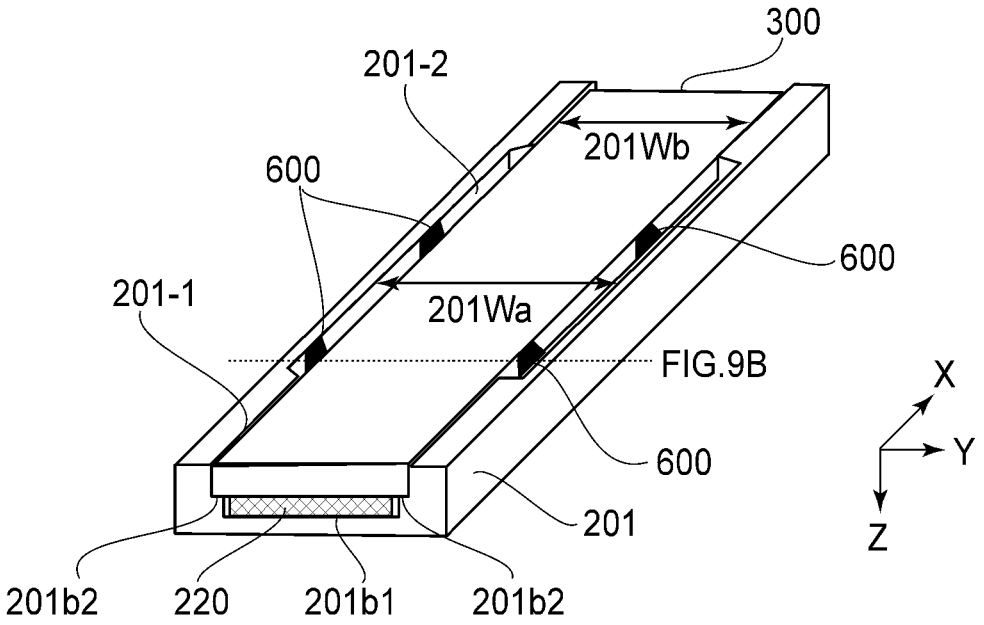
FIGS. 9A and 9B illustrate a device according to Embodiment 5.
Figure 9B:
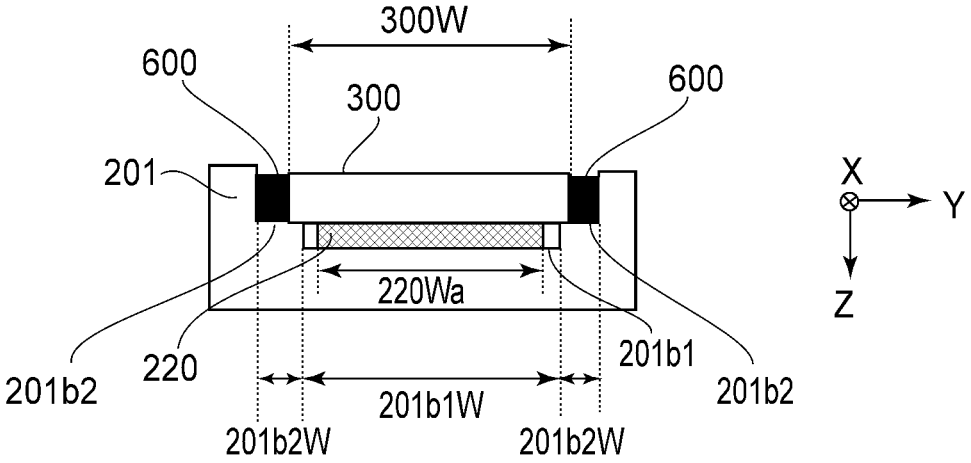

FIGS. 9A and 9B illustrate Embodiment 5. In this embodiment, the seat 201*b*2 (width is 201*b*2W) of the supporting member 201 supporting the heater 300 and the seat 201*b*1 (width is 201*b*1W) of the supporting member 201 supporting the high heat conduction member 220 are not flush with each other. Such a structure is also effective to prevent the disposition of the adhesive material 600 on the high heat conduction member 220.

Embodiment 6

Figure 11A:
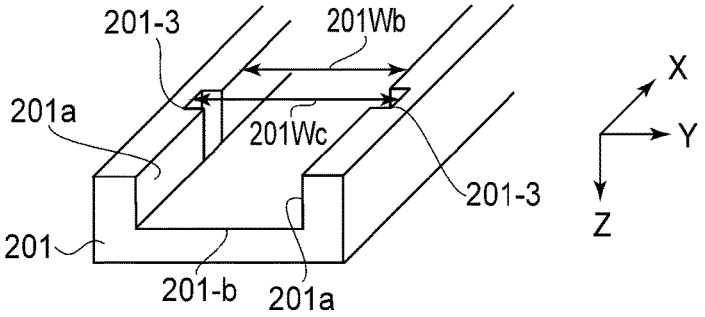
FIGS. 11A and 11B illustrate a device according to Embodiment 6.
Figure 11B:
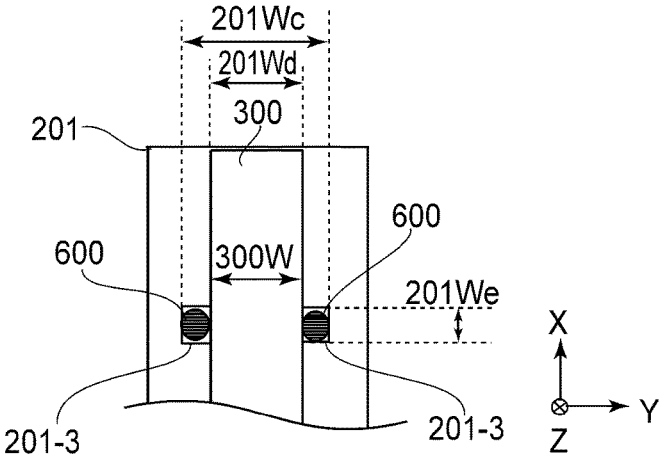

FIGS. 11A and 11B illustrate Embodiment 6. In the apparatus of this embodiment, no such spaces 201-2 as with the supporting member of Embodiment 1 are provided, and the side surface of the heater 300 is supported by the supporting member over the area along the X-direction, except for the recessed portion 201-3. In FIG. 11B, a high heat conduction member is provided in a downstream side of the heater 300 with respect to a Z-axis direction, but it is omitted in these figures.

Other Embodiments (1) The heating element 300 is not limited to the ceramic heater used in the foregoing embodiments. A heater using Nichrome® wire, which an induction heat generation member capable of electromagnetic induction heat generation using an excitation coil, is usable in place thereof.

(2) The use of the image heating apparatus according to the present invention is not limited to the above-described fixing device. It is usable with an image improving device for improving glossiness, or the like, by reheating the once or temporarily fixed toner image on the recording material.

(3) The image forming station of the image forming apparatus is not limited to the image forming station of the electrophotographic type. It may be an electrostatic recording type or a magnetic recording type. The image forming apparatus is not limited to that of the transfer type, but is usable with a direct transfer type in which the toner image is directly transferred onto the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

(A) a cylindrical film;

(B) a heater including a substrate and a heat generating element provided on the substrate, the heater having an elongated plate-like shape extending in a longitudinal direction, and having:

(a) a first surface contacting the film;

(b) a second surface opposite to the first surface; and (c) a heater lateral surface extending in the longitudinal direction and facing outwardly in a widthwise direction of the heat generating element;

(C) a supporting member supporting the heater, the supporting member being provided with a recess for supporting the heater, and having a supporting lateral surface that is parallel to and opposes the heater lateral surface, and that is provided in the recess, the heater lateral surface and the supporting lateral surface being bonded to each other by an adhesive material to affix the heater and the supporting member to each other; and (D) a high heat conduction member having a thermal conductivity greater than a thermal conductivity of the substrate, the high heat conduction member contacting the second surface of the heater and being sandwiched between the heater and the supporting member, wherein a recording material, on which an image is formed, is heated by heat from the heater through the film.

2. The image heating apparatus according to claim 1, wherein the supporting member has another supporting lateral surface that opposes the heater lateral surface in the widthwise direction, with a distance between the other supporting lateral surface and the heater lateral surface being greater than a distance between the supporting lateral surface and the heater lateral surface.

3. The image heating apparatus according to claim 1, wherein the heater further includes (d) another heater lateral surface extending in the longitudinal direction and facing outwardly in another widthwise direction that is opposite to the widthwise direction, wherein the supporting member has another supporting lateral surface that is parallel to and opposes the other heater lateral surface, and that is provided in the recess, the other heater lateral surface and the other supporting lateral surface being bonded to each other by another adhesive material to affix the heater and the supporting member to each other, and wherein the positions of the adhesive material and the other adhesive material overlap with each other as seen in a direction facing the heater lateral surface.

4. The image heating apparatus according to claim 1, wherein the adhesive material is out of contact with the high heat conduction member.

5. The image heating apparatus according to claim 2, wherein the other supporting lateral surface of the supporting member forms a part of a recessed portion that is recessed away from the heater lateral surface, and the adhesive material is applied in the recessed portion.

6. The image heating apparatus according to claim 5, wherein the recessed portion is provided with a portion that is deeper than a bottom surface of the supporting member that supports the second surface of the heater through the high heat conduction member.

7. The image heating apparatus according to claim 1, further comprising (E) a temperature detecting element for detecting a temperature of the heater, wherein the adhesive material is applied to a position that is the same as a position of the temperature detecting element with respect to the longitudinal direction.

8. The image heating apparatus according to claim 1, further comprising (E) a protection element for shutting off electrical power supply to the heater, wherein the adhesive material is applied to a position that is the same as a position of the protection element with respect to the longitudinal direction.

9. The image heating apparatus according to claim 1, wherein a depth of a first bottom surface of the supporting member that supports the second surface of the heater and a depth of a second bottom surface of the supporting member that supports the high heat conduction member are different from each other.

* * * * *